US009562737B2

(12) United States Patent
Stack

(10) Patent No.: US 9,562,737 B2
(45) Date of Patent: Feb. 7, 2017

(54) ELASTIC BAND LAUNCHER

(71) Applicant: Super Impulse USA, LLC, Bristol, PA (US)

(72) Inventor: Benjamin A. Stack, Broomall, PA (US)

(73) Assignee: Super Impulse USA, LLC, Bristol, PA (US)

( * ) Notice: Subject to any disclaimer, the term of this patent is extended or adjusted under 35 U.S.C. 154(b) by 0 days.

(21) Appl. No.: 14/906,285

(22) PCT Filed: Apr. 30, 2015

(86) PCT No.: PCT/US2015/028405
§ 371 (c)(1),
(2) Date: Jan. 20, 2016

(87) PCT Pub. No.: WO2016/175811
PCT Pub. Date: Nov. 3, 2016

(65) Prior Publication Data

US 2016/0370142 A1 Dec. 22, 2016

Related U.S. Application Data

(63) Continuation-in-part of application No. 29/525,567, filed on Apr. 30, 2015, now Pat. No. Des. 755,309.

(51) Int. Cl.
*F41B 7/00* (2006.01)
*F41B 7/02* (2006.01)

(52) U.S. Cl.
CPC ..... *F41B 7/025* (2013.01)

(58) Field of Classification Search
CPC ..... F41B 7/025
See application file for complete search history.

(56) References Cited

U.S. PATENT DOCUMENTS

| | | | |
|---|---|---|---|
| 1,461,119 | A | 7/1923 | Harris |
| 1,572,350 | A | 2/1926 | Ecker |
| 1,724,271 | A | 8/1929 | Fisher |
| 1,724,708 | A | 8/1929 | Harris |
| 1,748,215 | A | 2/1930 | Fisher |
| 1,759,084 | A | 5/1930 | Baum et al. |
| 1,809,208 | A | 6/1931 | McFarland |
| 1,821,381 | A | 9/1931 | Gerkin |
| 1,826,053 | A | 10/1931 | Carpenter |

(Continued)

*Primary Examiner* — John Ricci
(74) *Attorney, Agent, or Firm* — Michael Crilly, Esquire

(57) ABSTRACT

A toy, namely, an elastic band launcher is presented. The invention includes a launch section, two band bridges, a handle section, a trigger assembly, a bridge section, and an anchor. The launch section includes a first launch surface at a first acute angle with respect to a second launch surface. The band bridges are separately disposed along the first launch surface. The trigger assembly is interposed between and fixed to one end of the launch and handle sections. The bridge section includes a pair of opposed ends separately fixed to another end of the handle and launch sections. The anchor is fixed to the second launch surface. The anchor, launch surfaces, band bridges, and trigger assembly are adapted to receive an elastic band. At least one band bridge constrains separation between the sides of the elastic band. The elastic band disposed between the band bridges defines a main pull vector. The main pull vector is disposed at second, third, and fourth acute angles with respect to the second launch surface, the anchor, and the first launch surface, respectively.

27 Claims, 10 Drawing Sheets

(56) References Cited

U.S. PATENT DOCUMENTS

| | | | |
|---|---|---|---|
| 1,890,403 | A | 12/1932 | Murdock |
| 1,892,209 | A | 12/1932 | Fisher |
| 1,909,927 | A | 5/1933 | Beauchamp et al. |
| 1,935,287 | A | 11/1933 | Damico |
| 1,944,377 | A | 1/1934 | Taylor |
| 2,001,267 | A | 5/1935 | Ross |
| 2,004,531 | A | 6/1935 | Leonard |
| 2,008,595 | A | 7/1935 | Reed |
| 2,021,776 | A | 11/1935 | Hagen |
| 2,059,062 | A | 10/1936 | Tomita et al. |
| 2,065,580 | A | 12/1936 | Grawunder |
| 2,098,001 | A | 11/1937 | Gagnon et al. |
| 2,248,424 | A | 7/1941 | Coker |
| 2,284,512 | A | 5/1942 | Claytor et al. |
| 2,289,490 | A | 7/1942 | Fisher |
| 2,334,332 | A | 11/1943 | Johnson |
| 2,462,723 | A | 2/1949 | Crnich |
| 2,529,047 | A | 11/1950 | Paul |
| 2,550,873 | A | 5/1951 | Siders |
| 2,573,142 | A | 10/1951 | Herring |
| 2,576,248 | A | 11/1951 | Wright et al. |
| 2,578,198 | A | 12/1951 | Muggli |
| 2,610,619 | A | 9/1952 | Mikkelson, Jr. |
| 2,625,147 | A | 1/1953 | Eagleson, Jr. |
| 2,676,581 | A | 4/1954 | Moore |
| 2,680,434 | A | 6/1954 | Lodahl |
| 2,689,558 | A | 9/1954 | Sealer et al. |
| 2,697,425 | A | 12/1954 | McElveen |
| 2,730,094 | A | 1/1956 | Hicks |
| 2,793,637 | A | 5/1957 | Daffier |
| 2,878,802 | A | 3/1959 | Kuch |
| 2,917,037 | A | 12/1959 | Henderson |
| 3,119,385 | A | 1/1964 | Ashley |
| 3,408,996 | A | 11/1968 | Lilleoren, Jr. et al. |
| 3,437,084 | A | 4/1969 | Hyter |
| 3,468,296 | A | 9/1969 | Duval |
| 3,494,345 | A | 2/1970 | Griffiths |
| 3,515,387 | A | 6/1970 | House |
| 3,556,072 | A | 1/1971 | Levin |
| 3,618,584 | A | 11/1971 | Pigeon |
| 3,693,609 | A | 9/1972 | Vodinh |
| 3,757,760 | A | 9/1973 | Darnell |
| 3,812,833 | A | 5/1974 | Skillern |
| 3,919,996 | A | 11/1975 | McAlister |
| 4,223,658 | A | 9/1980 | Sundstrom |
| 4,308,850 | A | 1/1982 | Hunter |
| 4,379,445 | A | 4/1983 | LoBiondo |
| 4,436,077 | A | 3/1984 | Smith |
| 4,552,365 | A | 11/1985 | Smith |
| 4,676,219 | A | 6/1987 | Miller |
| 4,800,864 | A | 1/1989 | Small |
| 4,827,892 | A | 5/1989 | Vandermeide |
| 4,949,494 | A | 8/1990 | Mims |
| 5,170,770 | A | 12/1992 | Vosloh |
| 5,205,266 | A | 4/1993 | Kilby, Jr. |
| 5,222,472 | A | 6/1993 | Landingham |
| 5,460,150 | A | 10/1995 | Joppe |
| 5,692,489 | A | 12/1997 | Swanson et al. |
| 7,690,371 | B2 | 4/2010 | Slaven |
| 8,607,771 | B1 | 12/2013 | Marsh |
| 2007/0105480 | A1 | 5/2007 | Raviele |
| 2013/0340734 | A1 | 12/2013 | Coulston |

ELASTIC BAND LAUNCHER

CROSS REFERENCE TO RELATED APPLICATIONS

This application is a United States National Phase Application of PCT Application No. PCT/US2015/028405 filed Apr. 30, 2015 entitled Improved Elastic Band Launcher; this application is also a continuation-in-part of U.S. Design Pat. No. 29/525,567 filed Apr. 30, 2015; the before mentioned priority applications concurrently filed, co-pending and commonly assigned. The subject matters of the prior applications are incorporated in their entirety herein by reference thereto.

FEDERALLY SPONSORED RESEARCH AND DEVELOPMENT

None.

BACKGROUND OF THE INVENTION

1. Field of the Invention

The invention generally relates to a toy and more particularly is concerned, for example, with a launcher for elastic bands. Specifically, the invention is an elastic band launcher that minimizes the energy lost during launch so as to optimize conversion of potential energy to kinetic energy and that improves the flight characteristics of an elastic band so as to optimize range and accuracy.

2. Background

A variety of toy launchers capable of launching one or more rubber bands are known within the art. Presently known launchers include features that frustrate proper launch of a rubber band thereby degrading the performance of such launchers.

In one example, a rubber band is often secured to the front end of a launcher via an anchor, typically a pin or a post, and to the back end of a launcher via a release mechanism, typically an escapement wheel or a slidable trigger. The design, location, and/or functionality of anchor and release mechanism permit unwanted interactions between the rubber band and the structure of a launcher after release of the rubber band.

In another example, a rubber band is disposed in a stretched configuration along a substantial length of the launcher. This arrangement permits a rubber band to contact and interact with the launcher body as the rubber band contracts during conversion of potential energy to kinetic energy.

When interactions between a rubber band launcher and a rubber band are not adequately controlled, the kinetic energy of a rubber band otherwise possible after launch is either absorbed or dissipated by the launcher. Furthermore, uncontrolled interactions between a rubber band and a launcher induce asymmetries and perturbations at various points along the rubber band causing the rubber band to tumble, wobble, and/or expand, thereby increasing drag and energy losses and decreasing range and accuracy. The end result is a rubber band with less than optimal kinetic energy and flight characteristics.

As is readily apparent from the discussions above, the related arts do not provide a launcher that optimizes the kinetic energy and stability of an elastic band after launch. In particular, the related arts do not describe a device that controls the release of an elastic band and minimizes friction and drag induced losses. As such, the related arts limit the range and precision achievable by an elastic band launcher.

Accordingly, what is required is an elastic band launcher that optimizes the kinetic energy of one or more elastic bands after launch so as to maximize the range achievable by the elastic band(s).

Accordingly, what is also required is an elastic band launcher that releases one or more elastic bands in a controlled fashion so as to reduce drag-induced effects after launch.

Accordingly, what is also required is an elastic band launcher that releases one or more elastic bands in a controlled fashion so as to minimize deviations from a flight path after launch ensuring arrival at an aim point.

SUMMARY OF THE INVENTION

An object of the invention is to provide an elastic band launcher that optimizes the kinetic energy of one or more elastic bands after launch so as to maximize the range achievable by the elastic band(s).

An object of the invention is to provide an elastic band launcher that releases one or more elastic bands in a controlled fashion so as to reduce drag-induced effects after launch.

An object of the invention is to provide an elastic band launcher that releases one or more elastic bands in a controlled fashion so as to minimize deviations from a flight path after launch ensuring arrival at an aim point.

In accordance with embodiments of the invention, an elastic band launcher includes a launch section, a pair of band bridges, a handle section, a trigger assembly, a bridge section, and an anchor. The launch section includes a first launch surface disposed at a first acute angle with respect to a second launch surface. The band bridges are separately disposed along the launch section. The trigger assembly is interposed between and fixed to a first end of each of the launch and handle sections. The trigger assembly includes an escapement wheel with at least one spoke. The escapement wheel is rotatable and lockable. The bridge section includes a pair of opposed ends separately fixed to a second end of each of the handle and launch sections. The anchor is fixed to the second launch surface. The anchor, first and second launch surfaces, band bridges, and escapement wheel are adapted to receive an elastic band. The elastic band is securable at one end to one spoke and at another end to the anchor. At least one band bridge constrains separation between a first side and a second side of the elastic band. The elastic band between the band bridges defines a main pull vector. The main pull vector is disposed at a second acute angle with respect to the second launch surface, a third acute angle with respect to the anchor, and a fourth acute angle with respect to the first launch surface.

In accordance with other embodiments of the invention, one band bridge is adjacent to the handle section.

In accordance with other embodiments of the invention, one band bridge is adjacent to the intersection between the first and second launch surfaces.

In accordance with other embodiments of the invention, an upper surface of at least one band bridge is curved inward.

In accordance with other embodiments of the invention, an upper surface of at least one band bridge is angled inward.

In accordance with other embodiments of the invention, the first acute angle is greater than 0 degrees and no more than 45 degrees.

In accordance with other embodiments of the invention, the first acute angle is from 5 degrees to 30 degrees.

In accordance with other embodiments of the invention, the second acute angle is from 5 degrees to 80 degrees.

In accordance with other embodiments of the invention, the second acute angle is from 20 degrees to 50 degrees.

In accordance with other embodiments of the invention, the third acute angle is from 5 degrees to 40 degrees.

In accordance with other embodiments of the invention, the fourth acute angle is from 0 degrees to 45 degrees.

In accordance with other embodiments of the invention, the fourth acute angle is from 5 degrees to 40 degrees.

In accordance with other embodiments of the invention, the second launch surface is fixed to the elastic band launcher.

In accordance with other embodiments of the invention, the second launch surface is movable with respect to the elastic band launcher.

In accordance with other embodiments of the invention, the elastic band launcher includes a groove and a first front attachment. The groove partially traverses the launch section adjacent to the first launch surface. The first front attachment includes a shaft extending from an extension. The groove is adapted to receive the shaft so that the extension extends from a front end of the elastic band launcher. The second launch surface is disposed along the extension.

In accordance with other embodiments of the invention, the trigger assembly includes a trigger arm and a resilient element. The trigger arm is rotatable with respect to the trigger assembly. The resilient element biases the trigger arm against the escapement wheel to prevent rotation of the escapement wheel. The escapement wheel releases from the trigger arm and rotates when the resilient element is stretched by said trigger arm.

In accordance with other embodiments of the invention, the elastic band launcher includes a latch rotatable with respect to the elastic band launcher. The latch is adapted to interact with a notch along the shaft to releasably lock the first attachment to the elastic band launcher.

In accordance with other embodiments of the invention, the resilient element is also attached to the latch and biases the latch toward the notch to secure the shaft to the elastic band launcher. The shaft is released when the resilient element is stretched by rotation of the latch.

In accordance with other embodiments of the invention, the extension includes at least one additional first launch surface and at least one additional second launch surface. One anchor is fixed to each additional second launch surface.

In accordance with other embodiments of the invention, the elastic band launcher includes a forward hand grip extending from the first front attachment and adapted to receive a second front attachment. The second front attachment includes a second extension with at least one first notch and at least one second notch adapted to receive and to secure at least one said elastic band to said second front attachment.

In accordance with other embodiments of the invention, the elastic band launcher includes a pair of arms disposed along the second extension and adapted to receive and to secure at least one elastic band to the second front attachment. The arms are arranged to direct the elastic band onto one anchor along the first attachment when the elastic band is removed from the arms.

In accordance with other embodiments of the invention, one arm is rotatable and biased via a resilient element to contact the other arm.

In accordance with other embodiments of the invention, the second extension includes at least one additional first launch surface and at least one additional second launch surface. One anchor is fixed to each additional second launch surface.

In accordance with other embodiments of the invention, the second front attachment is fixed to the first front attachment.

In accordance with other embodiments of the invention, the elastic band launcher includes a rear attachment attachable at one end to the elastic band launcher and attached at another end to a pad. The rear attachment extends from a back end of the elastic band launcher.

In accordance with other embodiments of the invention, the elastic band launcher includes a forward hand grip attached to and extending outward from the bridge section.

In accordance with other embodiments of the invention, the elastic band is asymmetrically tensioned between the spoke and the anchor.

Several advantages are offered by the invention. The invention reduces energy loses during launch of an elastic band by minimizing contacts between surfaces along an elastic band and an elastic band launcher. The invention releases an elastic band in a controlled fashion by constraining lateral movement along the length of an elastic band so that an elastic band remains lengthwise aligned with the primary pull vector or launch axis during and after launch. The invention releases an elastic band in a controlled fashion so as to minimize asymmetries induced during separation of the elastic band from the launcher which cause tumble, wobble, and/or expansion of the elastic band.

The above and other objectives, features, and advantages of the preferred embodiments of the invention will become apparent from the following description read in connection with the accompanying drawings, in which like reference numerals designate the same or similar elements.

BRIEF DESCRIPTION OF THE DRAWINGS

Additional aspects, features, and advantages of the invention will be understood and will become more readily apparent when the invention is considered in the light of the following description made in conjunction with the accompanying drawings.

DETAILED DESCRIPTION OF THE INVENTION

Figure 1:
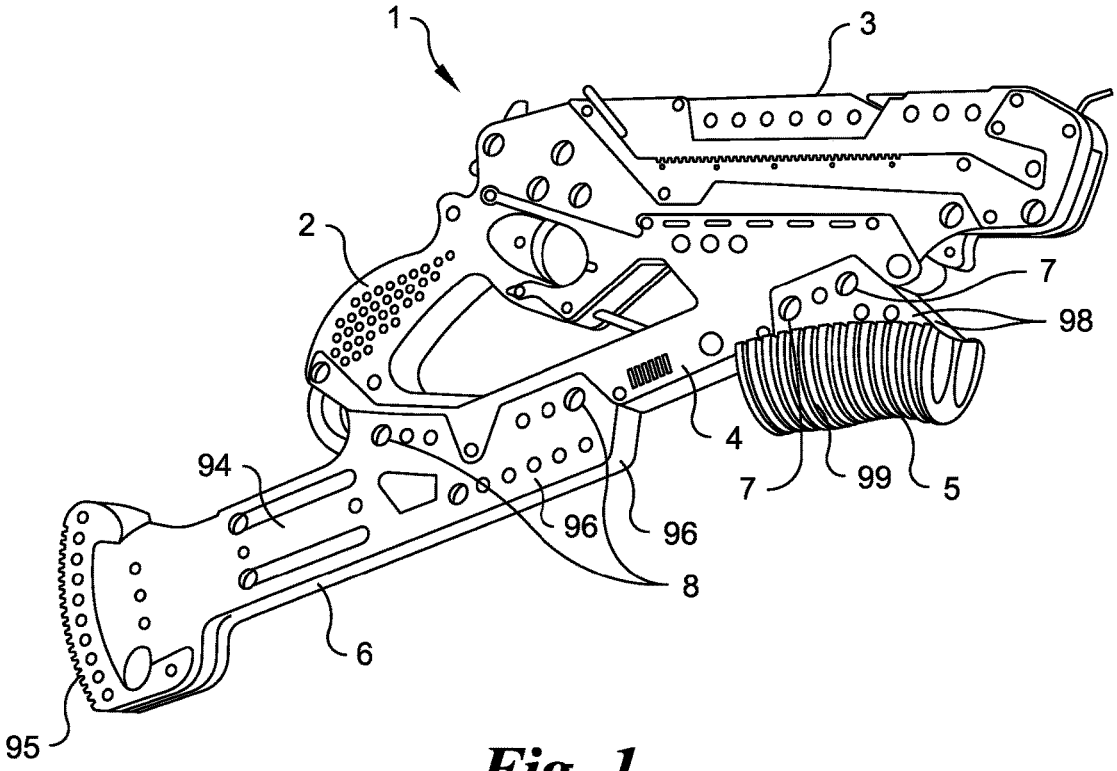
FIG. 1 is a perspective view illustrating an elastic band launcher with an optional rear attachment and an optional forward hand grip in accordance with an embodiment of the invention.

Reference will now be made in detail to several embodiments of the invention that are illustrated in the accompanying drawings. Wherever possible, same or similar reference numerals are used in the drawings and the description to refer to the same or like parts. The drawings are in simplified form and are not to precise scale.

While features of various embodiments are separately described herein, it is understood that such features may be combinable to form other additional embodiments.

Components described herein are manufactured via methods, processes, and techniques understood in the art, including, but not limited to, machining, molding, forming, milling, and three-dimensional printing. Unless otherwise indicated, components may be composed of a plastic, wood, metal, and/or other suitable materials.

Referring now to FIG. 1, the elastic band launcher 1 is shown in one exemplary embodiment with an optional rear attachment 6 and an optional forward hand grip 5. The elastic band launcher 1 includes a handle section 2, a launch section 3, and a bridge section 4. The launch section 3 is an elongated structure disposed in a substantially horizontal orientation to form the top portion of the elastic band launcher 1. The handle section 2 is an elongated structure that intersects the back end of the launch section 3 and extends downward therefrom. The bridge section 4 is an elongated structure oriented substantially diagonal that intersects the front end of the launch section 3 and the bottom end of the handle section 2. The arrangement of handle section 2, launch section 3, and bridge section 4 generally defines a triangular-shaped structure whereby the launch section 3 is adapted to receive and launch an elastic band (not shown), the handle section 2 is adapted to be a primary handle element, and the bridge section 4 is adapted to receive one or more optional elements.

Referring again to FIG. 1, the optional rear attachment 6 could include an arm 94 interposed between a pair of brackets 96 and a pad 95. The pad 95 is secured at one end of the arm 94 via an adhesive, fasteners or other means understood in the art. The pad 95 could be composed of a pliable and/or resilient material, examples including but not limited to rubber and foam. The pad 95 could be contoured and shaped to minimize discomfort when the rear attachment 6 contacts the shoulder or arm of a user. The brackets 96 could be molded, formed, or attached to the forward end of the arm 94 in a substantially parallel arrangement so as to extend therefrom. The brackets 96 are adapted to overlay and to receive a portion of the bridge section 4. The brackets 96 are secured to the bridge section 4 via fasteners 8, or other means understood in the art, thereby securing the rear attachment 6 to the elastic band launcher 1. The arm 94 extends from the lower end of the bridge section 4 and away from the handle section 2. The arm 94 could be a generally elongated element as represented in FIG. 1 or include one or more linear and non-linear features that optimize use as a shoulder stock.

Referring again to FIG. 1, the optional forward hand grip 5 includes a pair of brackets 98 and a grip 99. In some embodiments, the grip 99 could be composed of a pliable and/or resilient material, examples including but not limited to rubber, foam, or other suitable material. The grip 99 could be contoured and shaped to facilitate contact with the fingers, thumb, and palm of a user. The brackets 98 could be molded, formed, or attached to one side of the grip 99 so that the brackets 98 extend substantially parallel from the grip 99. The brackets 98 are adapted to overlay and to receive a portion of the bridge section 4. The brackets 98 are secured to the bridge section 4 via fasteners 7, or other means understood in the art, thereby securing the forward hand grip 5 to the elastic band launcher 1.

Figure 2:
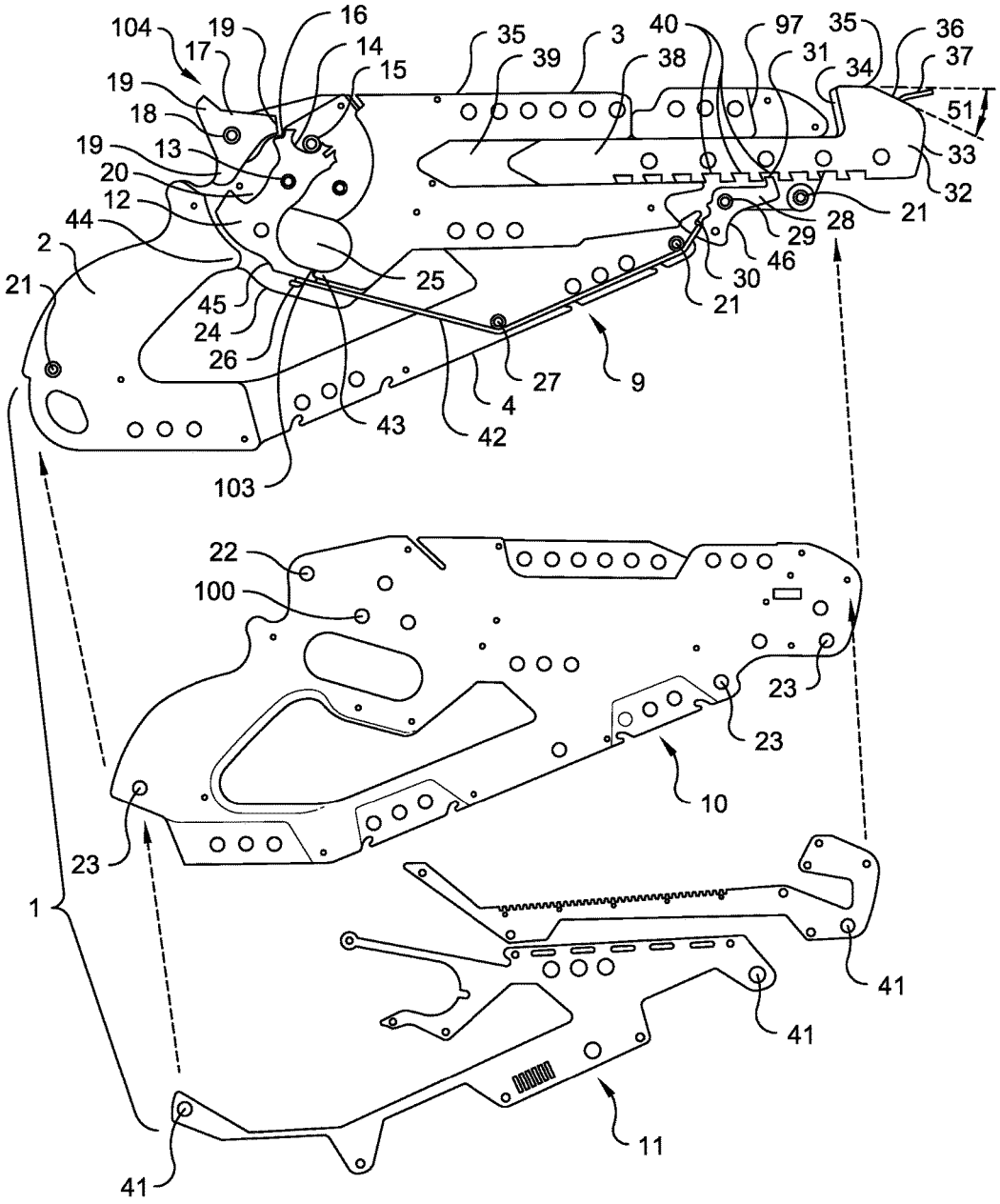
FIG. 2 is an explode view illustrating a center body, an outer cover, and ornamental elements (outer cover and ornamental elements on far side of center body not shown) for an elastic band launcher in accordance with an embodiment of the invention.

Referring now to FIG. 2, the body of the elastic band launcher 1 could be assembled from two or more elements. In some embodiments, the elastic band launcher 1 includes a center body 9, a pair of outer covers 10, and ornamental elements 11. The outer cover 10 and ornamental elements 11 along the near side of the center body 9 are illustrated in FIG. 2. It is understand that an outer cover 10 and ornamental elements 11 are also provided along the far side of the center body 9. The center body 9 is configured to hold and support several functional components of the elastic band launcher 1. An outer cover 10 is placed over each side of the center body 9 to substantially conceal the center body 9 and functional components. One or more ornamental elements 11 are placed onto the outside surface of each outer cover 10 to enhance the aesthetics of the elastic band launcher 1. In other embodiments, the body of the elastic band launcher 1 could include a two-piece housing whereby functional components are assembled onto the interior of one housing. The housings are then assembled in a clamshell arrangement and secured via means understood in the art. Ornamental elements 11 could be molded onto or attached to the exterior surface of each housing element. The attachments described herein are similarly constructed via two or more assembled parts or one or more molded parts.

Referring again to FIG. 2, the trigger assembly 104 is positioned within the center body 9 between the handle section 2 and the launcher section 3. This arrangement places the trigger assembly 104 at the back end of the launcher section 3 and the top end of the handle section 2. The trigger assembly 104 includes a rotatable trigger arm 12, a rotatable escapement wheel 17 that interacts with the trigger arm 12, and a trigger hole 25.

Referring again to FIG. 2, the trigger arm 12 is assembled onto a sleeve 13 fixed to and extending from the center body 9. The trigger arm 12 includes a notch 14 located adjacent to a second sleeve 15 that is fixed to and extends from the center body 9. The trigger arm 12 rotates about the sleeve 13 within a limited are defined by interaction between the sleeve 15 and the notch 14 at the top of the trigger assembly 104 and by interaction between a mechanical stop 44 along the center body 9 and a shoulder 45 at the lower end of the trigger assembly 104.

Figure 3:
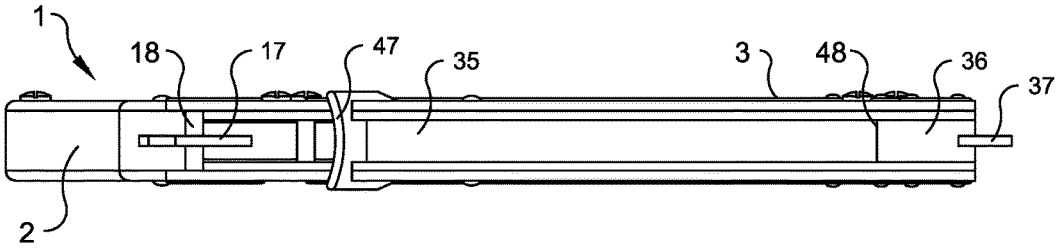
FIG. 3 is a top view illustrating band bridges along an elastic band launcher in accordance with an embodiment of the invention.

Referring again to FIG. 2, the escapement wheel 17 is assembled onto a third sleeve 18 that is fixed to and extends from the center body 9. The sleeve 18 passes through the escapement wheel 17, as illustrated in FIG. 3, allowing the escapement wheel 17 to rotate about the sleeve 18. Two or more spokes 19 extend radially from the escapement wheel 17. Each spoke 19 is shaped to engage a notch 16 disposed at the upper end of the trigger arm 12. Interaction between one spoke 19 and the notch 16 prevents the escapement wheel 17 from freely rotating about the sleeve 18 when an elastic band (not shown) is brought into contact with a second spoke 19. A resilient element 42, examples including but not limited to a rubber band and a spring, is attached at one end to a hook 26 that extends from lower end of the trigger arm 12. The resilient element 42 further contacts a sleeve 27 or a pin fixed to the center body 9. The resilient element 42 is tensioned to bias the lower end of the trigger arm 12 toward the bridge section 4 thereby allowing contact between a stop 43 along the center body 9 and a shoulder 103 extending from the trigger arm 12. This arrangement also biases the upper end of the trigger arm 12 toward the handle section 2 allowing contact between one spoke 19 and the notch 16.

The trigger hole 25 is formed by overlapping holes along the center body 9 and the outer covers 10. The trigger hole 25 is bounded in part by a trigger guard 24 along the center body 9 and the lower portion of the trigger arm 12. The trigger hole 25 is dimensioned to enable a user to engage the trigger arm 12 via an index finger. An index finger applies a force onto the trigger arm 12 in the direction of the handle section 2 further stretching and tensioning the resilient element 42 so as to negate the bias imposed thereby. The resultant motion causes the lower portion of the trigger arm 12 to rotate backwards and the upper portion of the trigger arm 12 to rotate forwards. The first spoke 19 contacting the notch 16 is released as the trigger arm 12 rotates so that the spoke 19 passes along a notch 20 along the back side of the trigger arm 12. The force causing the escapement wheel 17 and spokes 19 to rotate is applied by the elastic band contacting the second spoke 19. The elastic band contacting the second spoke 19 along the upper end of the trigger assembly 104 is then released from the escapement wheel 17.

Referring again to FIG. 2, the launch section 3 includes a first launch surface 35 and a second launch surface 36. The first and second launch surfaces 35, 36 are generally planar elements that intersect at a first acute angle 51 generally defined to be greater than 0 degrees and no more than 80 degrees. In preferred embodiments, the first acute angle 51 is greater than 0 degrees and no more than 45 degrees. In most preferred embodiments, the first acute angle 51 is from 5 degrees to 30 degrees.

Figure 4:
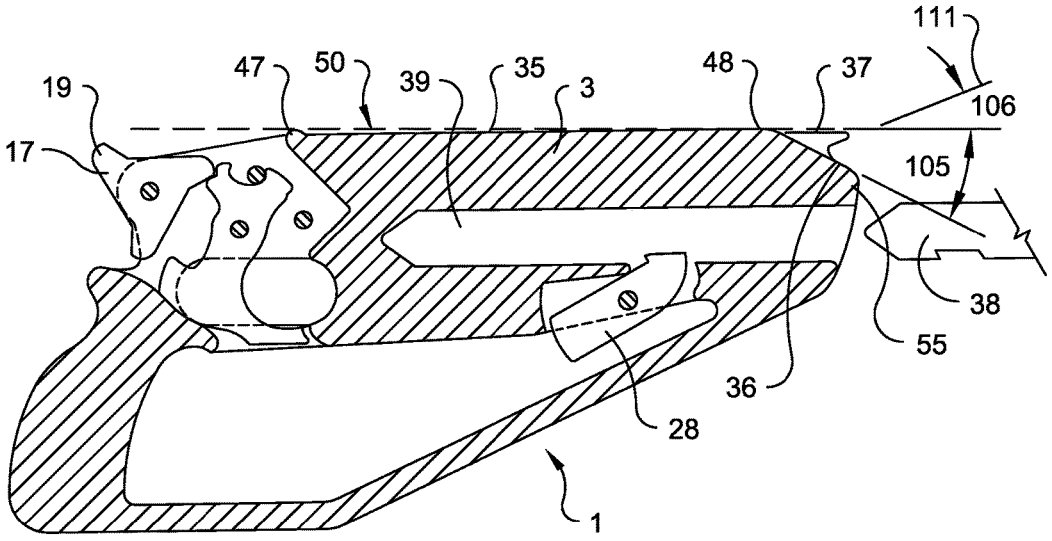
FIG. 4 is a side section view illustrating an anchor secured to an elastic band launcher, a pair of band bridges disposed along a first launch surface of the launcher, and a latch mechanism for securing an optional front attachment to the launcher in accordance with an embodiment of the invention.

Referring again to FIG. 2, an anchor 37 is fixed to and extends from the second launch surface 36. The anchor 37 is understood to be an element that enables a releasable attachment between the front end of an elastic band and the elastic band launcher 1. In some embodiments, the anchor 37 could be a wire as illustrated in FIG. 2 or a planar-disposed element as illustrated in FIG. 4. Other functionally equivalent designs are possible.

Referring again to FIG. 2, the second launch surface 36 in some embodiments could be movable with respect to the elastic band launcher 1. The elastic band launcher 1 could include a groove 39 disposed along a portion of the launch section 3 substantially parallel to the first launch surface 35. The second launch surface 36 resides along a front attachment 32 including an extension 33 and a shaft 38. The groove 39 is adapted to receive the shaft 38 extending from the extension 33 so that the shaft 38 slidably engages the groove 39. The second launch surface 36 is disposed along the extension 33. The extension 33 could also include an optional first launch surface 35 aligning with and complementing the first launch surface 35 along the launch section 3. The shaft 38 could include one or more notches 40 that facilitate locking of the front attachment 32 to the elastic band launcher 1. The spacing between notches 40 and overall lengths of the shaft 38 and groove 39 enable a user to adjust the distance between the anchor 37 and the spoke 19 (onto which an elastic band is secured) based on the length of and the stretch required by an elastic band. The back end of the front attachment 32 could include a shoulder 34 that engages a stop 97 along the center body 9 when the shaft 38 is completely retracted into the groove 39.

Referring again to FIG. 2, the elastic band launcher 1 in some embodiments could include a latch 28 disposed rotatably about a sleeve 29 that is fixed to and extends from the center body 9. The latch 28 could include a first hook 30 and a second hook 31 disposed at opposite ends thereof. One end of the resilient element 42 could be secured to the hook 30 and the other end of the resilient element 42 secured to the hook 26 along the trigger arm 12. The resilient element 42 could contact sleeves 21, 27 extending from the center body 9 along the bridge section 4. The resilient element 42 is tensioned so that the trigger arm 12 is biased as described herein and the latch 28 is biased so that the hook 31 engages a notch 40 along the shaft 38. Two or more notches 40 could reside along the shaft 38 to permit more or less tensioning of an elastic band or to accommodate an elastic band that is shorter or longer. The hook 31 disengages the notch 40 when a force is applied to the shoulder 46 adjacent to the first hook 30 stretching the resilient element 42 and causing the latch 28 to rotate clockwise thereby separating the hook 31 from the notch 40.

Referring again to FIG. 2, an outer cover 10 is secured onto each side of the center body 9 to partially cover the trigger arm 12 and the latch 28 within the elastic band launcher 1. Optional ornamental elements 11 are then secured onto the exterior of the outer covers 10. The outer covers 10 and ornamental elements 11 could include holes 22, 23, 41, 100 which align with the sleeves 13, 15, 18, 21, 27, 29 along the center body 9. The sleeves 13, 15, 18, 21, 27, 29 could be adapted to receive a fastener from one or both sides of the elastic band launcher 1. A fastener is inserted through the pairwise arrangement of holes 22, 23, 41, 100 along the outer cover 10 and ornamental element(s) 11 and into the corresponding sleeve 13, 15, 18 21, 27, 29. A fastener is secured to each sleeve 13, 15, 18, 21, 27, 29 via a thread or other mechanical or non-mechanical means understood in the art.

Referring now to FIGS. 3 and 4, the second launch surface 36 in some embodiments could be fixed to the nose 55 to the elastic band launcher 1. The elastic band launcher 1 could include an optional groove 39 with latch 28 adapted to receive a shaft 38 along a front attachment 32 and other such attachments described herein. The second launch surface 36 extends from the front of and is contiguous with the first launch surface 35.

Referring again to FIGS. 3 and 4, a first band bridge 47 and a second band bridge 48 are disposed along the first launch surface 35. Although the band bridges 47, 48 are illustrated in FIGS. 3 and 4 on elastic band launchers 1 with a second launch surface 36 fixed thereto, it is understood that band bridges 47, 48 are likewise applicable to embodiments wherein the second launch surface 36 is provided along an extendible attachment.

Referring again to FIGS. 3 and 4, each band bridge 47, 48 extends from the first launch surface 35 and away from the launch section 3. A band bridge 47, 48 could be an elongated element that extends from the launch section 3 as illustrated in FIG. 3 or a protrusion from the launch section 3 as illustrated in FIG. 4. A band bridge 47, 48 could extend perpendicular or at an angle with respect to the first launch surface 35. In some embodiments, the band bridge 47, 48 could be an element attached to the launch section 3 via mechanical or non-mechanical means, one example of the latter being attachment via an adhesive. In other embodiments, the band bridges 47, 48 could be molded, milled or formed onto the launch section 3. In preferred embodiments, the band bridges 47, 48 are separately disposed along the first launch surface 35. One band bridge 47 could be located adjacent to the escapement wheel 17. Another band bridge 48 could be located adjacent to the intersection between the first and second launch surfaces 35, 36.

Figure 5:
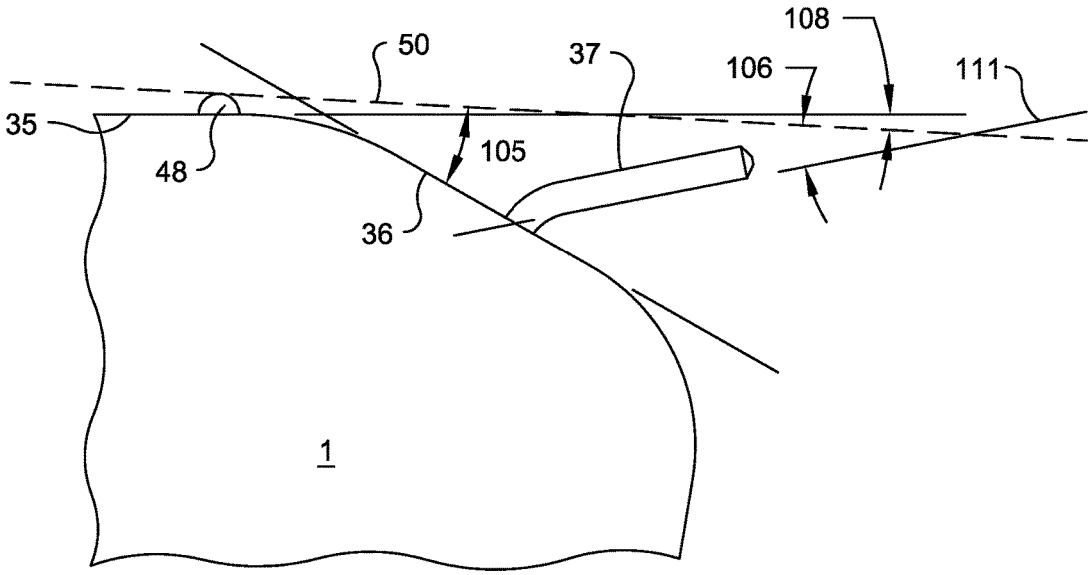
FIG. 5 is an enlarge side view illustrating angular orientation of anchor, first launch surface, and second launch surface with respect to a main pull vector in accordance with an embodiment of the invention.

Referring now to FIGS. 4 and 5, the band bridges 47, 48 are adapted to receive a portion of an elastic band (not shown) disposed between the anchor 37 and the spoke 19. The contact between the elastic band and the band bridges 47, 48, and the portion of the elastic band therebetween, generally define a main pull vector 50. The main pull vector 50 corresponds to the launch axis of the elastic band and generally represents the flight path of an elastic band after launch from the elastic band launcher 1. The main pull vector 50 is oriented with respect to the second launch surface 36 at a second acute angle 105 greater than 0 degrees and no more than 80 degrees. In preferred embodiments, the second acute angle 105 is from 5 degrees to 80 degrees. In most preferred embodiments, the second acute angle 105 is from 20 degrees to 50 degrees. The main pull vector 50 is oriented with respect to the release vector 111 along the anchor 37 at a third acute angle 106 greater than 0 degrees and no more than 80 degrees. The release vector 111 is generally aligned along and with the surface of the anchor 37 contacted by an elastic band. In preferred embodiments, the third acute angle 106 is from 5 degrees to 40 degrees. The main pull vector 50 is oriented with respect to the first launch surface 35, thereby defining a fourth acute angle 108 from 0 degrees to no more than 80 degrees. In preferred embodiments, the fourth acute angle 108 is from 0 degrees to 45 degrees. In most preferred embodiments, the fourth acute angle 108 is from 5 degrees to 40 degrees. In preferred and most preferred embodiments, the main pull vector 50 is oriented downward to pass through a projection from the first launch surface 35 at a point adjacent to or beyond the second launch surface 36.

Figure 6A:
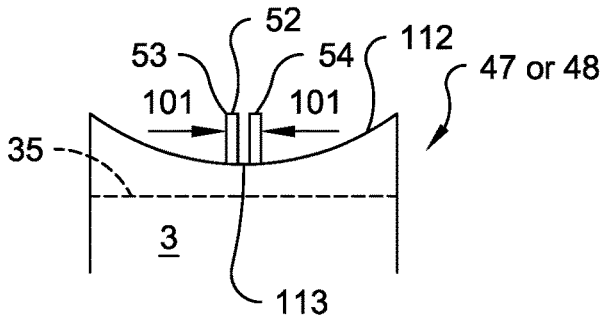
FIG. 6*a* is a diagrammatic cross-section view illustrating lateral compression of an elastic band by a band bridge with a curved-shaped upper surface in accordance with an embodiment of the invention.
Figure 6B:
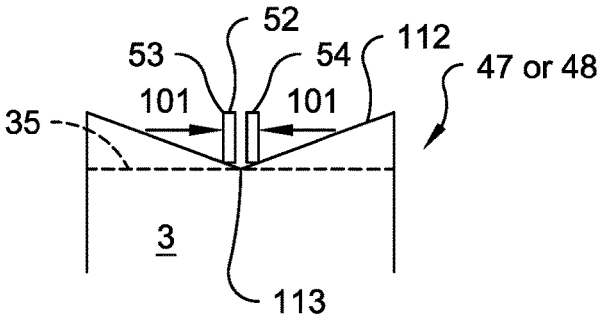
FIG. 6*b* is a diagrammatic cross-section view illustrating lateral compression of an elastic band by a band bridge with a wedge-shaped upper surface in accordance with an embodiment of the invention.
Figure 6C:
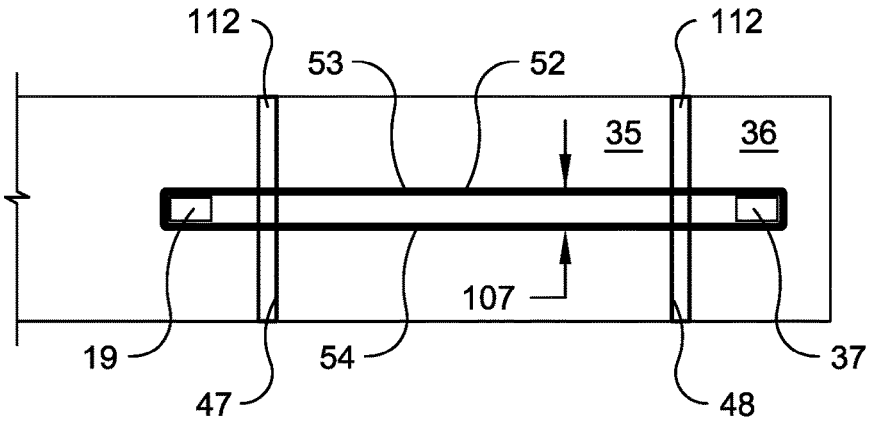
FIG. 6*c* is a diagrammatic top view illustrating alignment and lateral constraint of an elastic band contacting a pair of band bridges along a first launch surface of an elastic band launcher in accordance with an embodiment of the invention.

Referring now to FIGS. 6*a*-6*c*, the upper surface 112 along the band bridge 47, 48 is contoured so that a central portion is depressed below the outer or peripheral portions thereby defining a minima 113. The upper surface 112 could be shaped to inwardly curve as represented in FIG. 6*a* or to inwardly angle as represented in FIG. 6*b*. Other functionally similar shapes are possible for the upper surface 112. In preferred embodiments, the minima 113 are aligned along the center of the first launch surface 35 and further aligned with the anchor 37 and the spoke 19 extending outward from the trigger assembly 104. This arrangement centers the portion of an elastic band 52 disposed between the band bridges 47, 48 with the portions of the elastic band 52 disposed between the spoke 19 and first band bridge 47 and between the anchor 37 and the second band bridge 48, as illustrated in FIG. 6*c*. In preferred embodiments, the band bridges 47, 48 are oriented substantially perpendicular to the main pull vector 50.

Referring again to FIGS. 6*a*-6*c*, the upper surface 112 contacts both the left side 53 and the right side 54 of the elastic band 52 thereby applying a force 101. The force 101 generally constrains lateral movement of the elastic band 52 with respect to the band bridges 47, 48. The force 101, by way of example only, could be compressive or frictional in nature. The force 101 limits the separation 107 between the left and right sides 53, 54 and minimizes asymmetries between the left and right sides 53, 54 when the elastic band 52 is attached to and launched from the elastic band launcher 1. The separation 107 is also minimized via the width of the spoke 19 and anchor 37. In preferred embodiments, a width from 0.125-inches (3.175 millimeters) to 0.25-inches (6.35 millimeters) was sufficient to minimize launch-induced effects that degrade performance.

Referring again to FIGS. 6*a*-6*c*, the band bridge 47 adjacent to the spoke 19 should extend above the first launch surface 35 so that the minima 113 is disposed above the first launch surface 35, as represented in FIG. 6*a*. The band bridge 48 adjacent to the anchor 37 could be disposed along the first launch surface 35 so that the minima 113 extends above, extends below, or aligns with the first launch surface 35, the latter represented in FIG. 6*b*. In yet other embodiments, the band bridge 48 adjacent to the anchor 37 could reside at the intersection between the first and second launch surfaces 36 with or without the inwardly curved or inwardly angled features illustrated in FIGS. 6*a* and 6*b*, respectively. In preferred embodiments, the arrangement of the band bridges 47, 48 should ensure the elastic band 52 and corresponding main pull vector 50 slope downward in the direction of the second launch surface 36, as illustrated in FIG. 5. In other preferred embodiments, the band bridges 47, 48 either avoid or minimize contact between the elastic band 52 and the first launch surface 35. It is likewise preferred in some embodiments that the main pull vector 50 not intersect the anchor 37 so as to minimize contact between the rear portion of the elastic band 52 and anchor 37 during launch.

Referring again to FIGS. 4-6, the elastic band 52 could contact the band bridge 47 and slope downward to the contact point along the spoke 19. In preferred embodiments, the spoke 19 should release the elastic band 52 when the elastic band 52 is substantially aligned elevation wise with respect to the main pull vector 50. It is likewise possible for the elastic band 52 to contact the band bridge 48 and slope downward to the contact point along the anchor 37. In preferred embodiments, the shape or undercut of the anchor 37 should orient the release vector 111 so as to minimize the third acute angle 106. This feature minimizes asymmetries and other factors that degrade the kinetic energy, flight distance and accuracy of the elastic band 52 after release from the elastic band launcher 1. In some embodiments, the anchor 37 could extend above the first launch surface 35. In preferred embodiments, the top of the anchor 37 could extend approximately 0.0625-inches (1.5875 millimeters) above the first launch surface 35 without significantly degrading performance. In the most preferred embodiments, the top of the anchor 37 is either aligned with or below the first launch surface 35.

Figure 7:
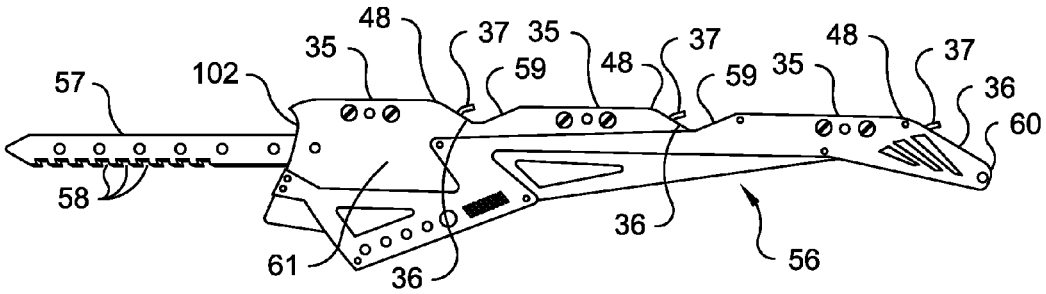
FIG. 7 is a side view illustrating an optional front attachment to an elastic band launcher capable of launching one or more elastic bands of the same or different lengths in accordance with an embodiment of the invention.

Referring now to FIG. 7, an alternate front attachment 56 includes an elongated extension 61 and a shaft 57. The shaft 57 extends from a shoulder 102 along one end of the extension 61. The shaft 57 is adapted to engage a groove 39 and could further include one or more notches 58 that interact with a latch 28, as described herein. The shoulder 102 could be adapted to contact a nose 55, as illustrated in FIG. 4, along an elastic band launcher 1 to maintain the aesthetics of the assembly.

Referring again to FIG. 7, one or more paired arrangements of first and second launch surfaces 35, 36 could reside along one surface of the extension 61. An anchor 37 extends from each second launch surface 36 as otherwise described herein. The additional anchors 37 permit a user to separately load one or more elastic bands 52 onto each anchor 37 and all elastic bands 52 onto one spoke 19 enabling simultaneous release of all elastic bands 52 from the elastic band launcher 1 and front extension 61. A band bridge 48 as described herein could be positioned adjacent to the intersection of each paired arrangement of first and second launch surfaces 35, 36. The second launch surface 36 adjacent to the front 60 is disposed along a surface depressed below the first launch surface 35. Each additional second launch surface 36 is disposed along a recess 59 along the top of the extension 61. Each recess 59 is configured is configured to minimize or avoid contact between an elastic band (not shown) and the extension 61 during launch. The shoulder 102 and shaft 57 are adapted so that the first launch surfaces 35 along the extension 61 aligns with a first launch surface 35 along the elastic band launcher 1.

Figure 8:
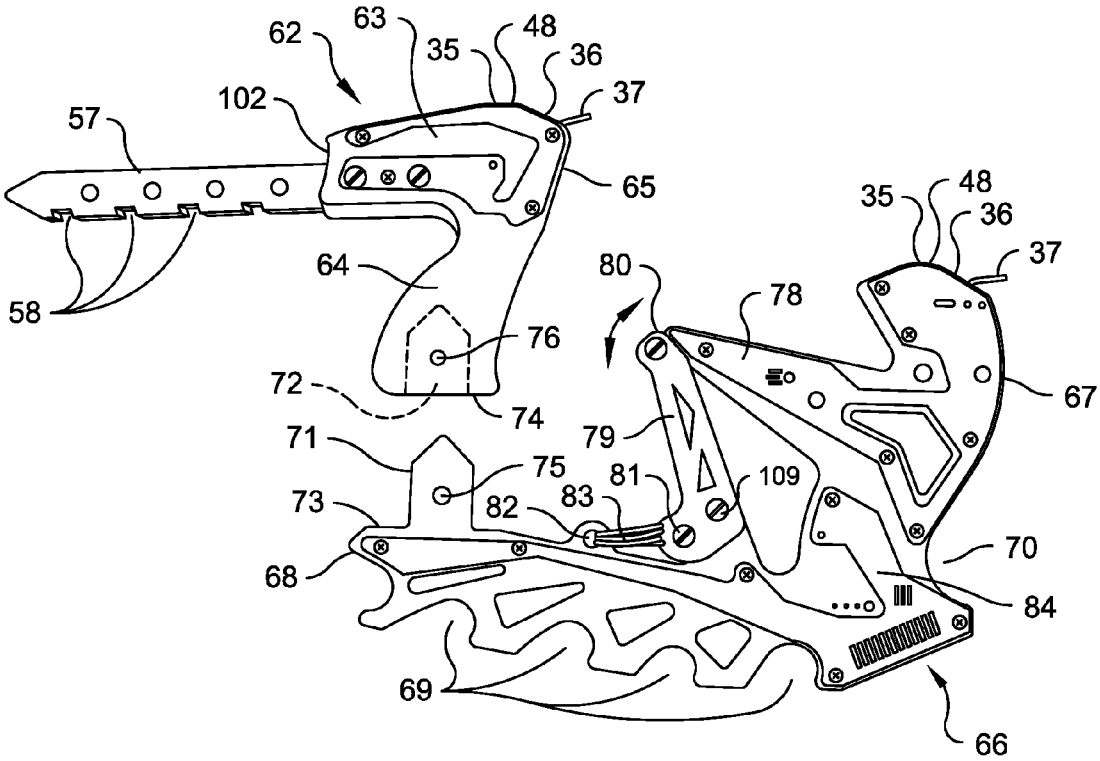
FIG. 8 is a side view illustrating a pair of optional front attachments to an elastic band launcher capable of launching and storing one or more elastic bands of the same or different lengths in accordance with an embodiment of the invention.

Referring now to FIG. 8, an alternate front attachment 62 includes an extension 63 and a shaft 57. The shaft 57 extends from a shoulder 102 along one end of the extension 63. The shaft 57 is adapted to engage a groove 39 and could further include one or more notches 58 that interact with a latch 28 as described herein. The shoulder 102 could be adapted to contact a nose 55, as illustrated in FIG. 4, along an elastic band launcher 1 to maintain the aesthetics of the assembly.

Referring again to FIG. 8, at least one paired arrangement of first and second launch surfaces 35, 36 could reside along one surface of the extension 63. An anchor 37 extends from the second launch surface 36 as otherwise described herein. A band bridge 48 as described herein could be positioned adjacent to the intersection of the first and second launch surfaces 35, 36. The second launch surface 36 adjacent to the front 65 is disposed along a surface depressed below the first launch surface 35. A forward hand grip 64 could extend downward from the extension 63 opposite of the first and second launch surfaces 35, 36.

Referring again to FIG. 8, the forward hand grip 64 could include an opening 72 adapted to receive a shaft 71 disposed adjacent to the rear 68 of an optional second front attachment 66. The opening 72 is comparable in shape and function to the groove 39 described herein. The shaft 71 is received into the opening 72 so that a shoulder 73 along the second front attachment 66 engages a shoulder 74 along the first front attachment 62. In some embodiments, the shaft 71 and opening 72 could be sized for an interference fit. In other embodiments, the shaft 71 and opening 72 could be sized for a clearance fit. A hole 76 along the forward hand grip 64 could align with a hole 75 along the shaft 71 when the shaft 71 is properly seated within the opening 72. A pin or fastener is then inserted into the holes 75, 76 to prevent separation between the front attachments 62, 66. In other embodiments, the front attachments 62, 66 could be fixed to form a single, non-separable unit. In yet other embodiments, a front attachment 32, 56, 62 could be fixed to the elastic band launcher 1 to form a single, non-separable unit.

Referring again to FIG. 8, the front attachment 66 includes an extension 84 with two or more notches 69, 70, an upper arm 78, and a lower arm 79. At least one paired arrangement of first and second launch surfaces 35, 36 could reside along a top surface of the extension 84 adjacent to the front 67. The first launch surfaces 35 along the front attachments 62, 66 should substantially align with the first launch surface 35 along the elastic band launcher 1. An anchor 37 extends from the second launch surface 36 as otherwise described herein. A band bridge 48 could be positioned adjacent to the intersection of the first and second launch surfaces 35, 36. The upper arm 78 could be fixed to the extension 84. The lower arm 79 could extend toward the upper arm 78 and mutually contact at an upper end 80. One end of the lower arm 79 could be secured to the extension 84 via a pin 109 that allows the lower arm 79 to rotate. A resilient element 83, examples including but not limited to a rubber band and a spring, is secured at one end to a hole 82 along the extension 84 and at another end to a fastener 81 secured to the lower arm 79. The resilient element 83 is tensioned so as to bias the lower arm 79 against the upper arm 78 at the upper end 80. This arrangement permits the lower arm 79 to rotate way from the upper arm 78 when an elastic band 52 is inserted into or removed from between the upper and lower arms 78, 79 at the upper end 80.

Figure 9:
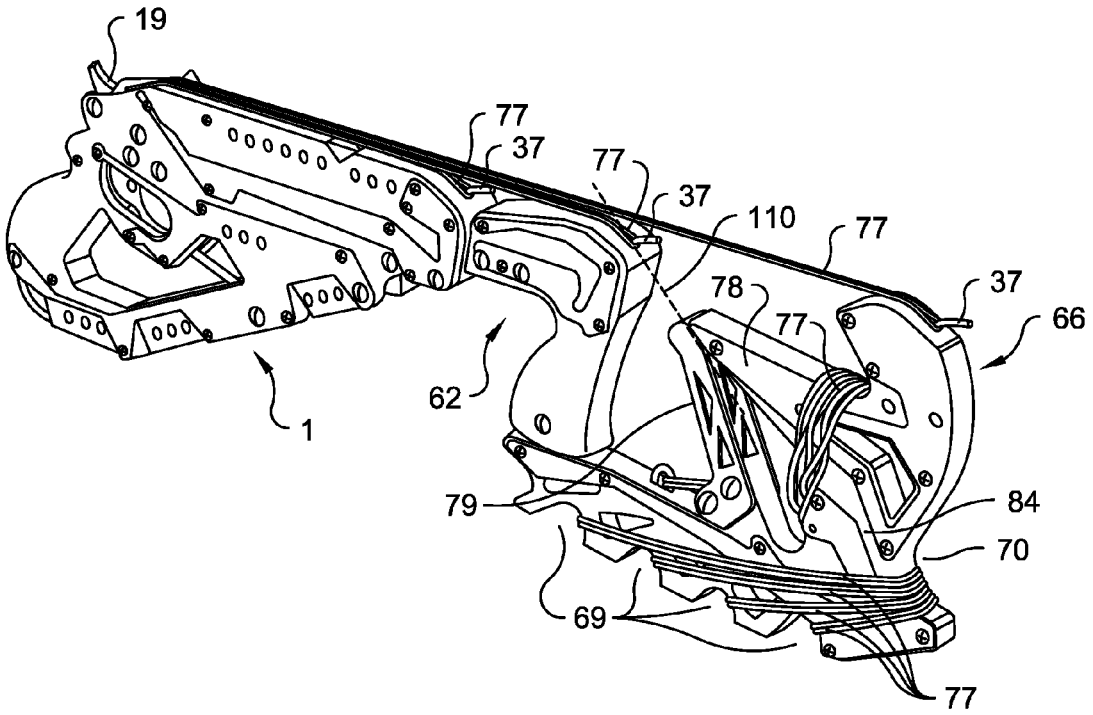
FIG. 9 is a perspective view illustrating attachment of elastic bands to an elastic band launcher with optional front attachments in FIG. 8.

Referring now to FIG. 9, the front attachments 62, 66 are assembled and further attached to an elastic band launcher 1. In one example illustrating the storage functionality of the assembly, the ends of an elastic band 77 are separately placed over a lower notch 69 and an upper notch 70 to secure the elastic band 77 to the front attachment 66 in a non-launchable arrangement. In another example, one or more elastic bands 77 could be placed over the upper arm 78 in a non-launchable arrangement. An elastic band 77 is placed onto the upper arm 78 by pulling the elastic band 77 forward along the upper end 80. An elastic band 77 is removed from the upper arm 78 by pulling the elastic band 77 rearward along the upper end 80. When the elastic band 77 engages the upper end 80, the applied force causes the lower arm 79 to rotate away from the upper arm 78 thereby seating the elastic band 77 onto or removing the elastic band 77 from the upper arm 78. After the elastic band 77 is seated or removed, the lower arm 79 rotates back to its original position to prevent release of other elastic bands 77 along the upper arm 78. In preferred embodiments, the upper arm 78 is oriented with respect to the anchor 37 along the first front attachment 62 so that the elastic band 77 is directed along a path 110 after release from the upper arm 78. The path 110 could intersect an anchor 37 thereby facilitating a rapid reload capability whereby one end of the elastic band 77 is directed into contact with the anchor 37.

Referring again to FIG. 9, the elastic band launcher 1, first front attachment 62, and second front attachment 66 permit a user to separately secure at least one elastic band 77 onto each anchor 37 and all elastic bands onto one spoke 19 enabling simultaneous release of all elastic bands 77. The elastic band launcher 1, first front attachment 62, and second front attachment 66 are then reloadable with elastic bands 77 secured to the second front attachment 66 as otherwise described herein.

Figure 10A:
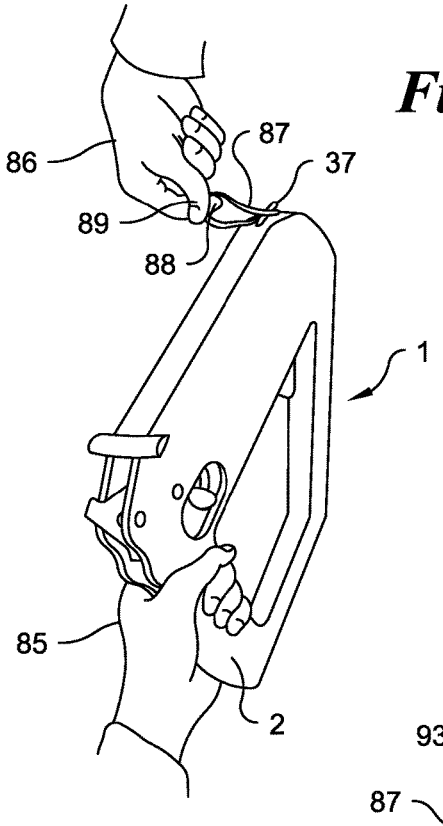
FIG. 10*a* is a diagrammatic perspective view illustrating a first step whereby an elastic band is placed onto an anchor at a front end of an elastic band launcher in accordance with an embodiment of the invention.
Figure 10B:
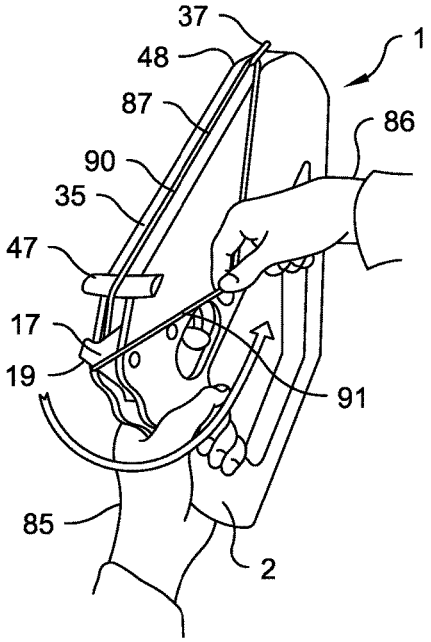
FIG. 10*b* is a diagrammatic perspective view illustrating a second step whereby an elastic band is stretched for placement onto an escapement wheel at a back end of an elastic band launcher in accordance with an embodiment of the invention.
Figure 10C:
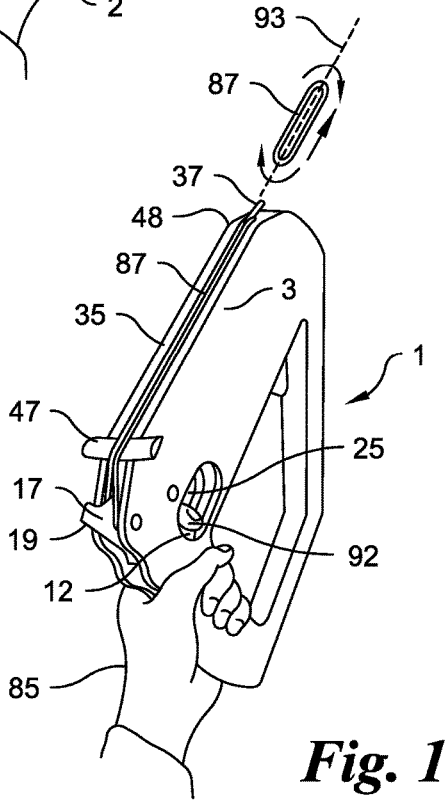
FIG. 10*c* is a diagrammatic perspective view illustrating a third step whereby a trigger is depressed to release an elastic band from a back end of an elastic band gun and subsequent travel of the elastic band after exit from the launcher in accordance with an embodiment of the invention.

FIGS. 10*a*-10*c* illustrate placement of an elastic band 87 onto an elastic band launcher 1 in a preferred method whereby the elastic band 87 is asymmetrically tensioned. The preferred method is applicable to the elastic band launchers 1 with or without optional front attachments 32, 56, 62, 66 described herein. The preferred method is not intended to limit or otherwise restrict or limit the scope of the elastic band launcher 1 and optional attachments 32, 56, 62, 66 described herein. Likewise, it is understood that other loading methods are possible whereby one or more elastic bands 87 are asymmetrically or symmetrically tensioned.

Referring now to FIG. 10*a*, the handle section 2 of the elastic band launcher 1 is grasped by a first hand 85 and an elastic band 87 is grasped between the index finger 88 and thumb 89 of a second hand 86. One end of the elastic band 87 is placed onto the anchor 37.

Referring now to FIG. 10*b*, the left side 90 of the elastic band 87 is stretched via the second hand 86 and placed over the first launch surface 35 so as to contact the band bridges 47, 48. In preferred embodiments, the elastic band 87 does not contact the first launch surface 35. A second end of the elastic band 87 is then placed onto a spoke 19 extending from the escapement wheel 17. The elastic band 87 is pulled away from the elastic band launcher 1 and then released from the second hand 86. The elastic band 87 is stretched between the anchor 37 and the spoke 19 so that the left side 90 is tensioned more than the right side 91. The left side 90 exhibits greater tension because a shorter length of unstretched elastic band 87 resides along the left side 90. Symmetric tensioning is achieved when the length of unstretched elastic band 87 is substantially equal along the left and right sides 90, 91.

Referring now to FIG. 10*c*, the index finger 92 of the first hand 85 is inserted into the trigger hole 25 and engages the trigger arm 12. The trigger arm 12 is depressed thereby releasing the escapement wheel 17 so that the escapement wheel 17 and spoke 19 rotate toward the launch section 3. The elastic band 87 is released from the spoke 19 as the spoke 19 rotates upward and forward. The elastic band 87 then traverses the band bridge 47, first launch surface 35, and second band bridge 48 thereafter separating from the anchor 37. After release from the elastic band launcher 1, the elastic band 87 traverses a path 93 consistent with the main pull vector 50. The asymmetric tensioning causes the elastic band 87 to rotate during flight. If the left side 90 is more tensioned, then the elastic band 87 rotates clockwise. If the right side 91 is more tensioned, then the elastic ban 87 rotates counterclockwise. It is believed that the rotation generates a gyroscopic force that elongates the elastic band 87 lengthwise along the path 93 thereby reducing drag and energy loss. The rotation also orients the elastic band 87 lengthwise with respect to the path 93 thereby minimizing flight asymmetries (tumbling and wobbling) and imparting lift to counteract gravitational effects.

Figure 11:
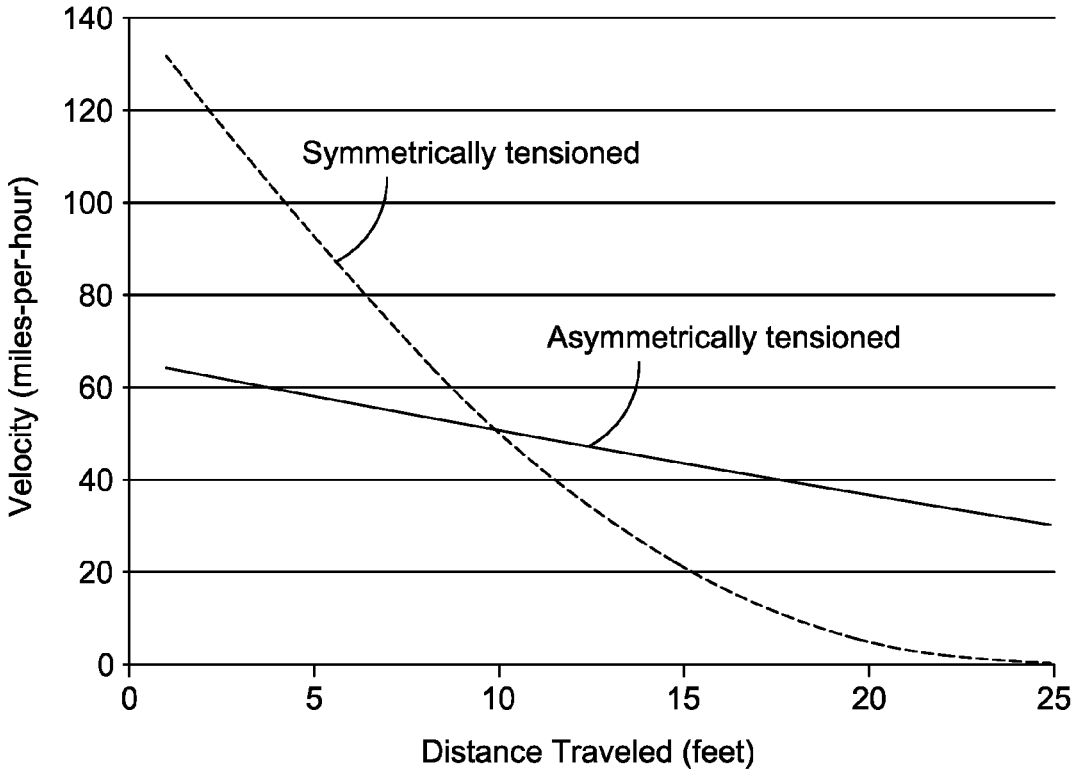
FIG. 11 is a velocity versus distance plot illustrating exemplary velocity decay profiles for an asymmetrically tensioned elastic band and a symmetrically tensioned elastic band.

Referring now to FIG. 11, exemplary velocity-distance profiles are shown for an asymmetrically tensioned elastic band 87 and a symmetrically tensioned elastic band 87. Although the asymmetrically tensioned elastic band 87 is launched at a lower initial velocity, the improved flight characteristics, namely reduced drag and greater lift, enable the elastic band 87 to fly a greater distance with less energy loss.

As is evident from the explanation herein, the described invention is an elastic band launcher with improved energy, range and accuracy. The invention is applicable to play by children and adults. Accordingly, the described invention is expected to be used, by way of example only, recreational play by individuals, commercial play at carnivals and fairs, and competitive play by individuals and groups.

The description above indicates that a great degree of flexibility is offered in terms of the present invention. Although various embodiments have been described in considerable detail with reference to certain preferred versions thereof, other versions are possible. Therefore, the spirit and scope of the appended claims should not be limited to the description of the preferred versions contained herein.

What is claimed is:

1. An elastic band launcher comprising:

(a) a launch section including a first launch surface disposed at a first acute angle with respect to a second launch surface;

(b) a pair of band bridges separately disposed along said launch section;

(c) a handle section;

(d) a trigger assembly interposed between and fixed to a first end of each of said launch section and said handle section, said trigger assembly including an escapement wheel with at least one spoke, said escapement wheel rotatable and lockable;

(e) a bridge section including a pair of opposed ends separately fixed to a second end of each of said handle section and said launch section; and (f) an anchor fixed to said second launch surface;

wherein said anchor, said first launch surface, said second launch surface, said band bridges, and said escapement wheel adapted to receive an elastic band, said elastic band securable at one end to one said spoke and at another end to said anchor, at least one said band bridge constrains separation between a first side and a second side of said elastic band, said elastic band between said band bridges defines a main pull vector, said main pull vector disposed at a second acute angle with respect to said second launch surface, said main pull vector disposed at a third acute angle with respect to said anchor, said main pull vector disposed at a fourth acute angle with respect to said first launch surface.

2. The elastic band launcher of claim 1, wherein one said band bridge is adjacent to said handle section.

3. The elastic band launcher of claim 1, wherein one said band bridge is adjacent to intersection between said first launch surface and said second launch surface.

4. The elastic band launcher of claim 1, where an upper surface of at least one said band bridge is curved inward.

5. The elastic band launcher of claim 1, where an upper surface of at least one said band bridge is angled inward.

6. The elastic band launcher of claim 1, wherein said first acute angle is greater than 0 degrees and no more than 45 degrees.

7. The elastic band launcher of claim 1, wherein said first acute angle is from 5 degrees to 30 degrees.

8. The elastic band launcher of claim 1, wherein said second acute angle is from 5 degrees to 80 degrees.

9. The elastic band launcher of claim 1, wherein said second acute angle is from 20 degrees to 50 degrees.

10. The elastic band launcher of claim 1, wherein said third acute angle is from 5 degrees to 40 degrees.

11. The elastic band launcher of claim 1, wherein said fourth acute angle is from 0 degrees to 45 degrees.

12. The elastic band launcher of claim 1, wherein said fourth acute angle is from 5 degrees to 40 degrees.

13. The elastic band launcher of claim 1, wherein said second launch surface is fixed to said elastic band launcher.

14. The elastic band launcher of claim 1, wherein said second launch surface is movable with respect to said elastic band launcher.

15. The elastic band launcher of claim 14, further comprising:

(g) a groove partially traverses said launch section adjacent to said first launch surface; and (h) a first front attachment including a shaft extending from an extension, said groove adapted to receive said shaft so that said extension extends from a front end of said elastic band launcher, said second launch surface disposed along said extension.

16. The elastic band launcher of claim 15, wherein said trigger assembly includes a trigger arm and a resilient element, said trigger arm rotatable with respect to said trigger assembly, said resilient element biases said trigger arm against said escapement wheel to prevent rotation of said escapement wheel, said escapement wheel releases from said trigger arm and rotates when said resilient element is stretched by said trigger arm.

17. The elastic band launcher of claim 16, further comprising:

(i) a latch rotatable with respect to said elastic band launcher, said latch adapted to interact with a notch along said shaft to releasably lock said first front attachment to said elastic band launcher.

18. The elastic band launcher of claim 17, wherein said resilient element is attached to said latch and biases said latch toward said notch to secure said shaft to said elastic band launcher, said shaft released when said resilient element is stretched by rotation of said latch.

19. The elastic band launcher of claim 15, wherein said extension includes at least one additional said first launch surface and at least one additional said second launch surface, one said anchor fixed to each additional said second launch surface.

20. The elastic band launcher of claim 15, further comprising:

(i) a second front attachment including a second extension with at least one first notch and at least one second notch adapted to receive and to secure at least one said elastic band to said second front attachment; and (j) a forward hand grip extending from said first front attachment and adapted to receive said second front attachment.

21. The elastic band launcher of claim 20, further comprising:

(k) a pair of arms disposed along said second extension and adapted to secure at least one said elastic band to said second front attachment, said arms arranged to direct said elastic band onto one said anchor along said first front attachment when said elastic band is removed from said arms.

22. The elastic band launcher of claim 21, wherein one said arm is rotatable and biased via a resilient element to contact other said arm.

23. The elastic band launcher of claim 20, wherein said second extension includes at least one additional said first launch surface and at least one additional said second launch surface, one said anchor fixed to each additional said second launch surface.

24. The elastic band launcher of claim 20, wherein said second front attachment is fixed to said first front attachment.

25. The elastic band launcher of claim 1, further comprising:

(g) a rear attachment attachable at one end to said elastic band launcher and attached at another end to a pad, said rear attachment extends from a back end of said elastic band launcher.

26. The elastic band launcher of claim 1, further comprising:

(g) a forward hand grip attached to and extending outward from said bridge section.

27. The elastic band launcher of claim 1, wherein said elastic band is asymmetrically tensioned between said spoke and said anchor.

* * * * *